US008201795B2

(12) United States Patent
Wolfford, Sr.

(10) Patent No.: US 8,201,795 B2
(45) Date of Patent: Jun. 19, 2012

(54) PORTABLE SUPPORT APPARATUS

(76) Inventor: Dennis Lee Wolfford, Sr., Houston, TX (US)

( * ) Notice: Subject to any disclaimer, the term of this patent is extended or adjusted under 35 U.S.C. 154(b) by 9 days.

(21) Appl. No.: 12/800,610

(22) Filed: May 19, 2010

(65) Prior Publication Data

US 2010/0230553 A1 Sep. 16, 2010

Related U.S. Application Data

(62) Division of application No. 11/336,133, filed on Jan. 21, 2006, now Pat. No. 7,731,145.

(51) Int. Cl.
*A47H 1/00* (2006.01)
*B66F 11/00* (2006.01)
*B66C 23/18* (2006.01)

(52) U.S. Cl. ..... 248/332; 248/317; 212/166; 212/179; 220/327; 414/589; 414/684.3

(58) Field of Classification Search ..... 248/317, 248/332, 327; 414/589, 684.3; 220/211, 220/327, 328, 321, 319; 403/259, 261, 270, 403/109.5, 256, 375, 220, 222; 212/166, 212/169, 175, 179; 411/103, 107, 267, 433
See application file for complete search history.

(56) References Cited

U.S. PATENT DOCUMENTS 510,300 A * 12/1893 E.R. Stilwell ..... 220/327
3,807,028 A 4/1974 DeLuca
4,291,931 A 9/1981 Stupay
4,297,072 A 10/1981 Shah et al.
4,360,310 A 11/1982 Kost
4,398,649 A 8/1983 Labbe
4,519,519 A * 5/1985 Meuschke et al. ..... 220/211
4,664,586 A 5/1987 Vassalotti
4,865,513 A 9/1989 Norris
4,989,818 A 2/1991 Trundle et al.
5,050,628 A 9/1991 Ripley et al.
5,431,248 A 7/1995 Willaughby
6,786,343 B1 9/2004 Porebski
7,556,160 B2 * 7/2009 Porebski et al. ..... 414/684.3
7,731,145 B2 * 6/2010 Wolfford ..... 248/317
2007/0290457 A1 * 12/2007 Walters ..... 279/48

* cited by examiner

*Primary Examiner* — Tan Le
(74) *Attorney, Agent, or Firm* — W. Allen Marcontell

(57) ABSTRACT

A portable manway cover handling apparatus comprises a lightweight support unit having a mounting tab secured to a manway stub flange within stub flange bolt holes by stud bolts projecting from expandable mandrel sleeves. A structural support beam is cantilevered from the mounting tab for attachment of a force line pulling machine. A force line from the pulling machine is attached to the manway cover and all manway flange bolts removed except a single loose hinge bolt proximate of the flange bottom. The pulling machine is operated to control the rotation of the manway cover about the hinge bolt to a stable suspension position whereat the manway portal is open.

3 Claims, 7 Drawing Sheets

PORTABLE SUPPORT APPARATUS

CROSS-REFERENCE TO RELATED APPLICATION

This application is a Division of presently pending application Ser. No. 11/336,133 filed Jan. 21, 2006. Applicant claims the Mar. 7, 2005 priority date benefit for the present Application under 35 USC §119 arising from Provisional Patent Application No. U.S. 60/659,548.

BACKGROUND OF THE INVENTION

1. Field of the Invention

The present invention relates to methods and devices for controllably handling relatively large flanged pipe and fittings. More particularly, the present invention relates to a novel method and apparatus for supporting a blind pipe flange or manway cover during removal and replacement procedures.

2. Description of Related Art

Numerous industrial vessels and structures such as tanks, drums and process towers are constructed with one or more large portals for the ingress and egress of maintenance personnel or equipment. Often, such portals are often characterized as "manways". The manway structure integral with the tank, drum or tower typically comprises a short length of 18" to 36", for example, steel pipe having one axial end welded to a structural wall of the tank, drum or tower, The opposite end of such a stub pipe length is fitted with a bolt flange which comprises a steel ring welded around the pipe perimeter. The ring has a radially projecting face surface that is transversely perforated by bolt holes distributed uniformly around the ring circumference.

The opening into the tank, drum or tower interior through the interior bore of the integrally attached stub pipe is the manway passage. Due to the fact that the very purpose of the tank, drum or tower is to confine a process environment, often under extreme temperature and/or pressure conditions, it is essential for the manway opening to be sealed during tank, drum or tower usage.

Frequently, if not usually, such manway openings are covered or closed by a steel, plate-like article having a perforated periphery to accommodate a plurality of clamping bolts distributed around the plate periphery. Some industries characterize such a manway cover as a "blind flange". The clamping bolts extend between the outside face of the cover plate and the backside face of the ring flange that is secured to the manway defining stub pipe to uniformly clamp the contiguous inner faces of the flange and plate against a sealing gasket.

It is not unusual for such a manway to be projected from the sheer, vertical face of a high pressure process tower at an elevation of 100 ft. or greater above the ground. To compound matters, due to a high operating pressure within the tower, the manway cover may be several inches thick. Consequently, the manway cover weight is several hundred pounds. Clearly, some form of mechanical assistance is required to remove and replace such a manway cover.

Mobile lifts and cranes are often used to support a manway cover during a removal or replacement process. However, restricted accessibility may prohibit the use of such machines in some cases. The prior art has suggested and utilized numerous attachments and fixtures secured to the tank, drum or tower to attach a suitable lifting device such a pulley, chain hoist or come-a-long. However, any permanently attached fixture is exposed to the elements and/or the immediate industrial atmosphere. Not infrequently, the industrial atmosphere is considerably more corrosive than the natural elements. Accordingly, the structural integrity and reliability of a permanently exposed structure deteriorates rapidly.

Although the prior art has proposed and produced numerous portable and temporary hoist hangers for the purpose of safely handling a heavy manway cover, few of the portable devices have found their way into the workplace. There may be many reasons for this result but foremost, such prior art devices are nearly as heavy as the manway cover to be supported and they are clumsy and time consuming to attach.

It is, therefore, an objective of the present invention to provide an implement and method of use for supporting a hoisting mechanism from a pipe flange.

Also an object of the present invention is a relatively small and light apparatus for attaching a hoist hanger eye to a pipe connecting flange.

Another object of the present invention is a method and apparatus for securing a structural appliance to one flange ring of a 2-ring joint without separating the rings or opening the joint.

SUMMARY OF THE INVENTION

The present invention provides a portable load supporting appliance adapted for bolted attachment to a pipe flange. Notably, the appliance may be bolted to a flange without opening the pipe joint formed by a bolted compression seal between two flanges. An important utility for the invention is for removing large manway covers from flanged manway portals. However, the invention may be adapted to many other utilities where it is convenient to secure a load lifting appliance to a flanged pipe.

The load supporting appliance includes a cantilevered or gusset reinforced beam that projects, substantially normally, from a perforated mounting tab. The mounting tab is adapted for bolted attachment to an outside flange face respective to a flanged pipe joint. In one embodiment of the invention, a load attachment or anchor device such as a hook, loop, bail, eye or an aperture for attaching such an anchor device may be attached to the distal end of the projecting beam to support a hoist or other manually operated force line pulling machine. In another embodiment of the invention, the beam may support a portable powered winch driven by electricity, hydraulic fluid or compressed air, for example.

One or more apertures, preferably 3 or more, through the mounting tab of the apparatus are positioned to substantially align with the flange bolt circle and bolt center spacing albeit not necessarily of the same aperture diameter as provided for the flange bolts. Preferably, each tab aperture receives the threaded shank portion of a collet bolt. Hence, the tab aperture inside diameters are greater than the crest diameter of the collet bolt shank threads. A threaded, nut reception end of the collet bolt shank projects past the "outside" face of the mounting tab.

The collet mandrel is an integral shaft having a substantially smooth surface having an axial (conical) taper on one end and a threaded bolt shank on the other. A collet sleeve that envelops the conically tapered end of the mandrel may comprise an outside diameter cylinder surface and an axially tapered inside bore surface. The conical angle of the sleeve bore usually corresponds to the taper angle of the collet mandrel. Additionally, the circumference of the sleeve is incomplete to allow an expansion of the sleeve outside diameter. Such incomplete circumference may take the form of a radial slot through the sleeve annulus that extends the axial length of the sleeve. Others may choose a helically developed slot. Another characteristic of the collet sleeve is that the outside diameter of the sleeve is greater than the inside diameter of the mounting tab bolt holes whereby advancement of a nut along the collet bolt threads against the outside face of the mounting tab draws the shaft mandrel against the tapered sleeve bore and consequently, the outer end of the collet sleeve against the inside face of the mounting tab to force an expansion of the mandrel sleeve outside diameter. The axial length of the collet sleeve and contiguously assembled mandrel is preferably no greater than the thickness of the support flange ring. Also in a loose, unstressed assembly, the outside diameter of the collet sleeve is sized to a convenient "slip-fit" into the support flange bolt holes.

Installation of the above described appliance includes the initial step of removing preferably several, but not all, flange sealing bolts. Usually, the flange bolts selected for removal will be within an arc proximate of an upper tangent to the flange. At this point, the joint between the contiguously compressed flanges constituting the joint remains structurally intact if not sealed. With the collet mandrel and sleeve elements in nested, coaxial assembly, the several collet bolts are inserted into the vacated flange bolt holes from the "backside" of the manway stub pipe flange. The collet sleeves should penetrate the supporting manway flange holes no more than the thickness of the supporting manway flange while the threaded end of the collet shaft projects through the mounting tab bolt receptacle apertures by a distance sufficient for full nut engagement as the contiguous face of the structural tab engages the "backside" face of the supporting manway flange. When relatively positioned and aligned, nuts on the threaded ends of the collet shafts are advanced along the threads and against the outer face of the mounting tab.

Continued advancement of the nuts along the collet shaft threads and against the outer face of the mounting tab axially displaces the contiguous, tapered face engagement between the mandrel and the sleeve. This relative axial displacement between the split sleeve and the mandrel expands the split sleeve outside surface tightly against the inside surface of the flange bolt holes. Expanded engagement of all sleeves in the assembly provides a secure anchor point for any weight supporting attachment to the distal end of the cantilevered beam.

A second cantilevered beam that projects in a direction from the mounting tab is secured to the pipe body that defines the manway portal. This second beam is preferably secured by temporary structures such a chains or cable to the manway pipe for torsional opposition forces about the mounting tab With an adjustable length force line pulling machine or hoisting mechanism secured to the first cantilevered beam, the loading end of a dynamic force line such as a chain or cable that is selectively displaced by the hoist is attached to the manway cover at some convenient point. A convenient point of attachment may include a welded lift ring or a collet bolt attachment as describe above.

As a final step in the manway cover removal process, all remaining flange fasteners are removed except one remaining hinge bolt proximate of the bottom of the bolt circle. This hinge bolt is only loosened.

In the foregoing configuration, the manway cover is under positive control, independent of any flange clamping bolts. If simple removal of the cover for working access through the manway portal into the tank, drum or tower is all that is required, discrete operation of the hoist mechanism will permit the cover to be controllably rotated about the remaining hinge bolt axis to a stable position that leaves the manway portal clear of obstruction.

BRIEF DESCRIPTION OF THE DRAWINGS

Distinctive features and advantages of the invention will be recognized and understood by those of skill in the art from reading the following description of the preferred embodiments and referring to the accompanying drawings wherein like reference characters designate like or similar elements throughout the several figures of the drawings and wherein.

DESCRIPTION OF THE PREFERRED EMBODIMENTS

Figure 1:
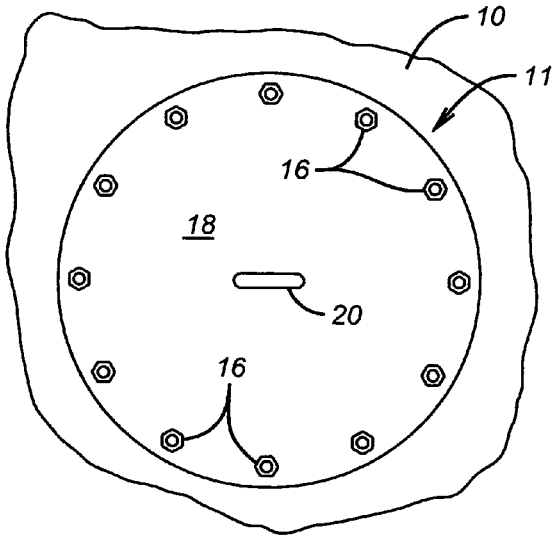
(PRIOR ART) FIG. 1
FIG. 1 is a prior art front elevation view of a typical utility environment for the invention.
Figure 2:
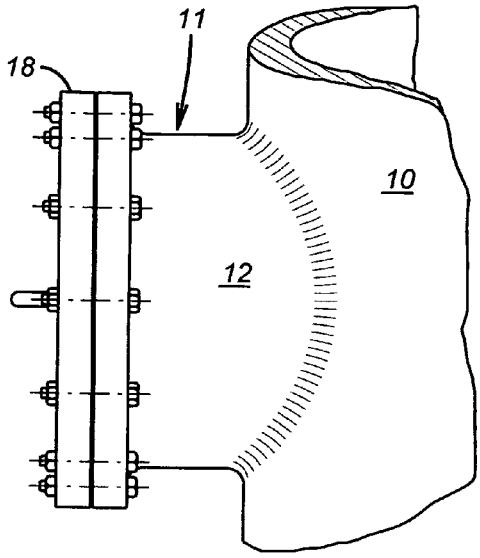
(PRIOR ART) FIG. 2
FIG. 2 is a prior art side elevation view of a typical utility environment for the invention.

A typical environmental setting for the invention is represented by prior art FIGS. 1 and 2 which illustrate a manway portal 11 into a tank, drum, process tower, vessel 10 or corresponding structural enclosure. Collectively, such enclosure shall hereafter be characterized as a "vessel" 10. In a frequently found construction form, the manway portal 11 comprises a short stub tube 12 welded at one end to the contiguous support vessel 10 and fitted with a bolt flange 14 at the other end. The stub tube is a cylindrical annulus, usually or iron or steel, that provides an open pathway or "manway" through the tube interior. The wall of the vessel 10 is cut away as a contiguous extension the stub tube 12 interior to project the stub tube open pathway into the vessel 10 interior.

The outer or exterior end of the stub tube interior pathway is normally closed by a manway cover 18. Depending on the particular use or industry, the manway cover 18 may also be known as a "flange plate" or a "blind flange". Although a circular cross-sectional configuration is illustrated for convenient representation of the preferred embodiments, those of skill in the art will understand that the invention may be effectively applied to manway covers 18 having an oval, elliptical, square, rectangle, triangular or any other geometric configuration suitable to the purpose.

Figure 11:
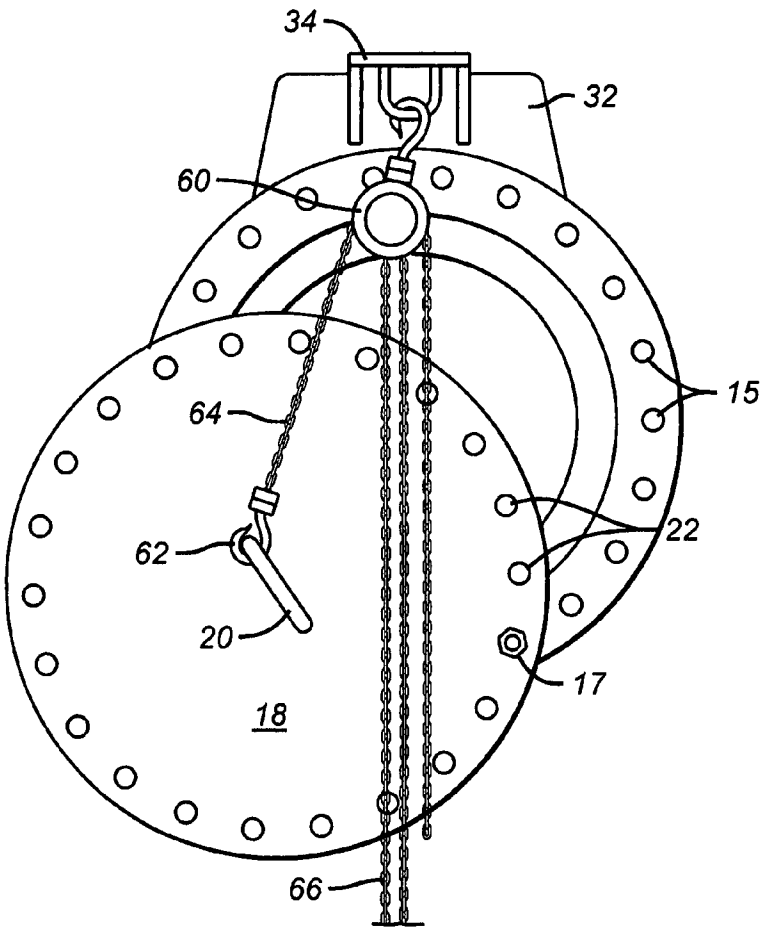
FIG. 11 is a manway cover displaced by the invention to a first, partially open, position.

Typically, manway covers are in the order of 18" to 40" diameter. Thickness is determined by the pressure expected within vessel enclosure. Due to the weight and mass often associated with a manway cover 18, the cover is often fitted with an eye or bail 20 for the convenient attachment of a load-lifting hook 62 (FIG. 11). Although the bail 20 presently illustrated is shown as centered on the manway cover 18, it is often positioned off-center to gravitationally accommodate a desired alignment when suspended from a load hook 62.

It is also the industry practice to secure a manway cover 18 to the stub flange 14 by means of a plurality of flange bolts 16. The flange bolts 16 penetrate a matching number of aligned bolt holes 15 in the stub flange 14 and 22 in the cover 18. When tightened against the outer faces 14*b* of the stub flange and 18*a* of the manway cover, the contiguous flange inner faces 14*a* and 18*b* are compressed against a sealing gasket (not shown) to seal the interface.

The method of manway cover 18 removal according to the invention generally comprehends a relatively light and portable suspension unit 30 that may be secured to the stub flange 14 independently of the manway cover 18. Pursuant to the suspension unit 30 attachment, several adjacent flange bolts 16 are removed from the upper arc of the flange bolt circle. Specialized collet bolts are inserted in the vacated stub flange holes 15 to project threaded stud bolts from the stub flange back-face 14*b* but not to project past the plane of the stub flange front face 14*a*. The vacated bolt holes in the manway cover 18 remain open. A mounting tab 32, preferably crafted from a structural metal plate, having bolt holes 33 spaced on a circle arc of the same radius as the stub flange bolt circle is aligned against the stub flange back-face 14*b* and secured by threaded stud extensions 47 of a collet mandrel 42. Compressive advancement of the stud nuts 49 turned against the outer face of the mounting tab 32 consequently expand a collet sleeve 50 inside the stub flange bolt holes 33.

One end of a cantilevered beam element 34 is secured to an upper edge of the mounting tab 32 as by welding, for example. The beam 34 projection may be reinforced by supporting gusset plates 36

From the portable suspension structure (30), some form of mechanical advantage pulling machine such as a winch, pulley, chain fall or "come-along" is attached. A dynamically retracted force line such as a chain, cable, rope, or webbed belt drawn by the'pulling machine is also attached to the manway cover 18 and drawn to a moderate tensile loading. Excepting a singular, designated flange bolt, characterized here as the pivot or hinge bolt 17, all other flange bolts 16 are removed. The designated hinge bolt 17 is proximate of the gravity bottom of the bolt perimeter. The hinge bolt 17 nut is turned to a loose assembly state. The manway cover is now free to rotate in the plane of the flange about the axis of the hinge bolt 17 except for the controllable retention force of the dynamic force line. Under the firm control of the pulling machine, the force line is lengthened to permit the manway cover 18 to gravitationally rotate about the hinge bolt 17 axis to a gravity stable position.

The manway cover 18 need not be completely detached from the stub flange 14 to provide entry access through the manway portal. The hinge bolt 17 provides a continuing structural link to the manway stub 12. Assuming continuing support by the hinge bolt 17, the manway cover is returned to the portal closure position by operating the pulling machine to retract the force line length.

The foregoing process is facilitated by the portable support unit 30 illustrated in detail by FIGS. 3 through 6. The mounting tab 32 includes several bolt holes 33 that are spaced to align with the center spacing of stub flange bolt holes 15. Additionally, the inside edge 35 of the mounting tab 32 plate, is spaced from the bolt holes 33 by a distance that is sufficient to avoid structural interference with the manway stub 12 or stub flange 14 when the tab 32 bolt holes 33 are aligned with the stub flange bolt holes 15.

Figure 4:
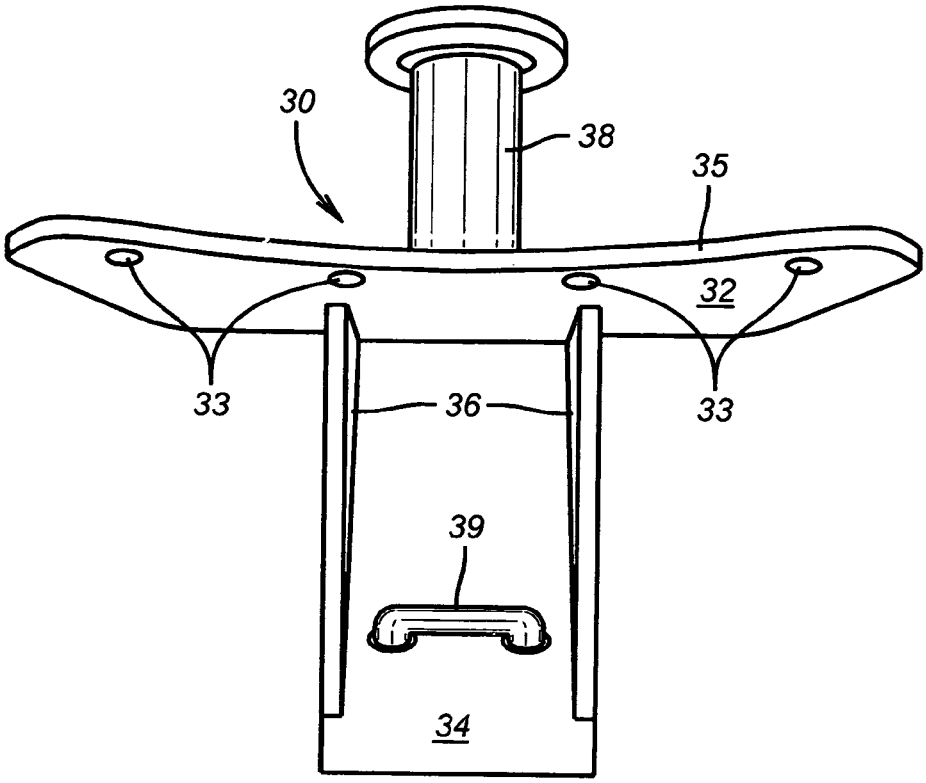
FIG. 4 is a pictorial bottom view of the invention.
Figure 5:
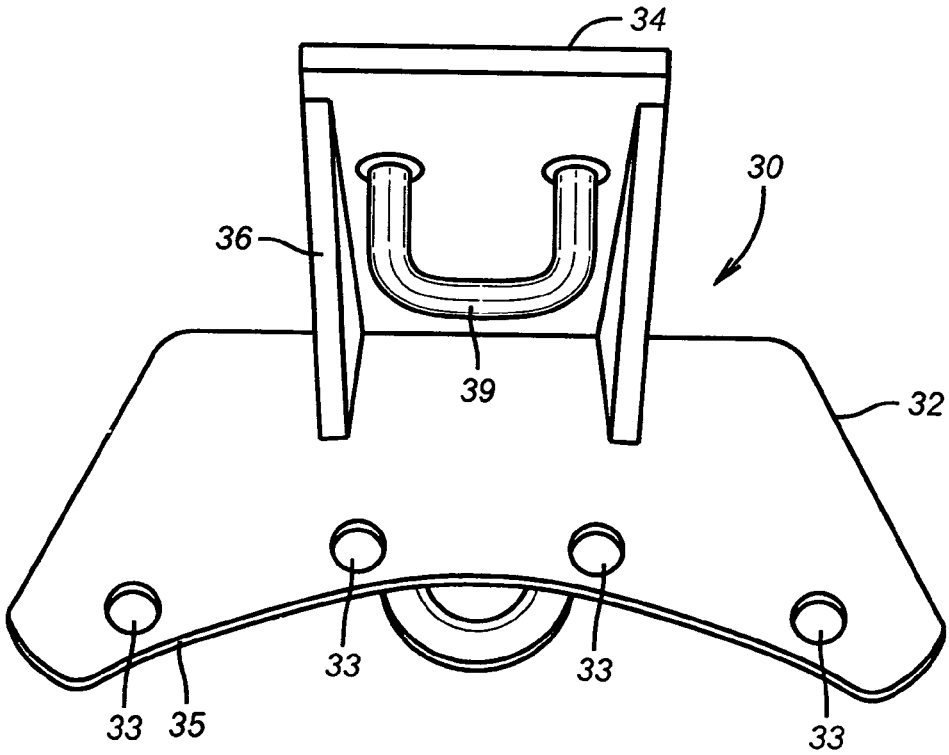
FIG. 5 is a pictorial front view of the invention.

As shown in detail by FIGS. 4 and 5, a beam element 34 is welded or otherwise secured to the upper plate edge of the mounting tab to project out over the manway 18 by a distance that is sufficient to conveniently position an eye or bail 39 on the beam 34 past the face plane of the manway cover 18 for hanging the pulling machine 60. Preferably, the beam 34 projection is reinforced by gussets 36.

Figure 3:
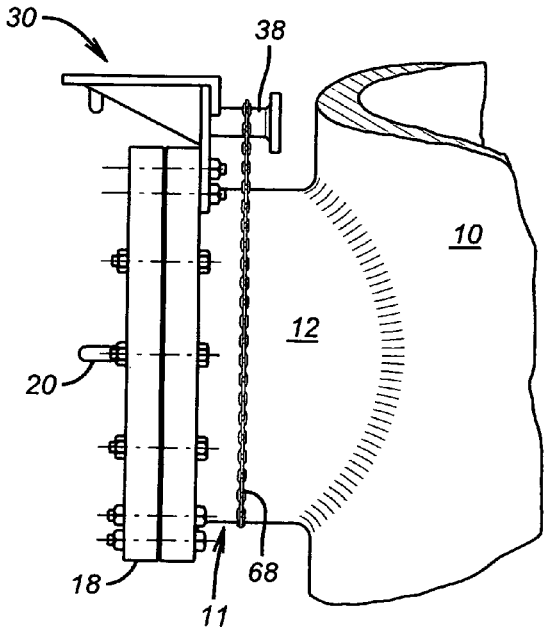
FIG. 3 is a side elevation of the invention mounted for an intended use.
Figure 6:
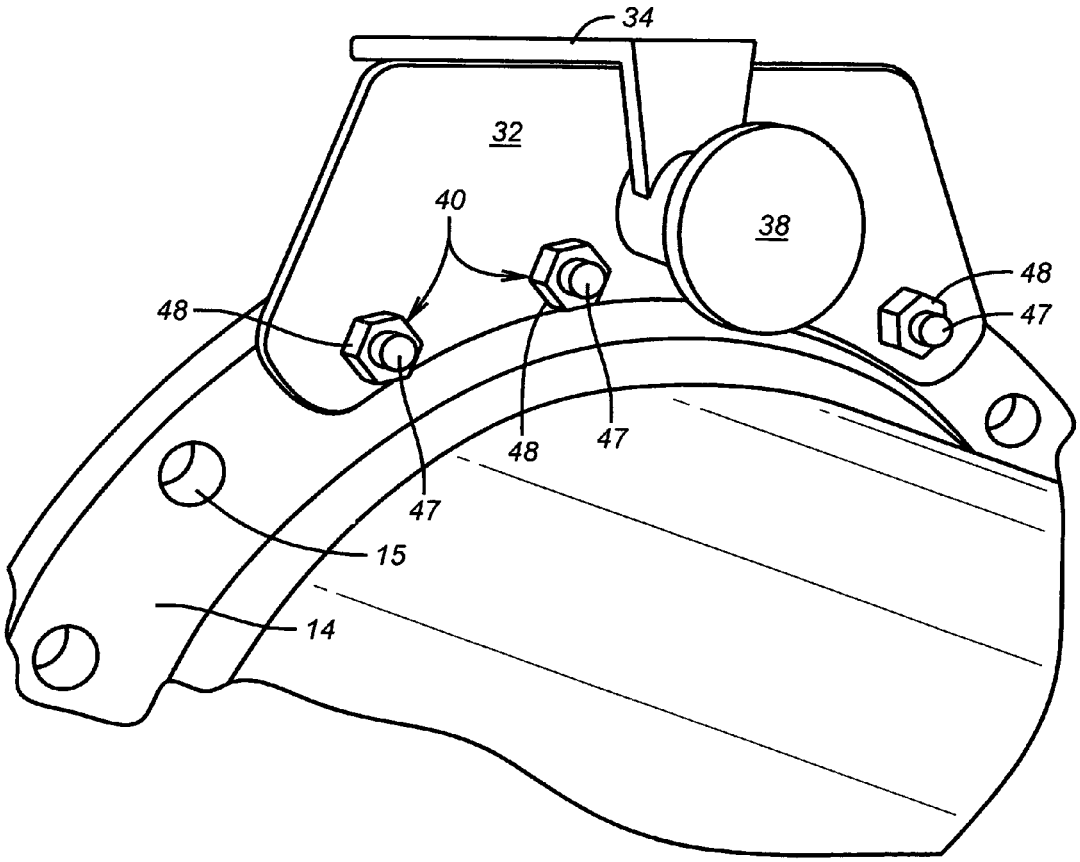
FIG. 6 is a pictorial back view of the invention mounted for an intended use.

As is best shown by FIGS. 3 and 6, a counter-force beam, preferably in the form of a spool 38, is secured to the opposite face of the mounting tab 32 to receive the overlay of a temporary structural binding means such as banding strap 68. The banding strap 68 may be a chain, cable, rope or web belt may be secured to or wrapped collectively over the counter-force beam/spool 38 and around the girth of the manway stub 12 to counter bending moment forces on and about the tab 32 as load is transferred to the beam 34.

Figure 7:
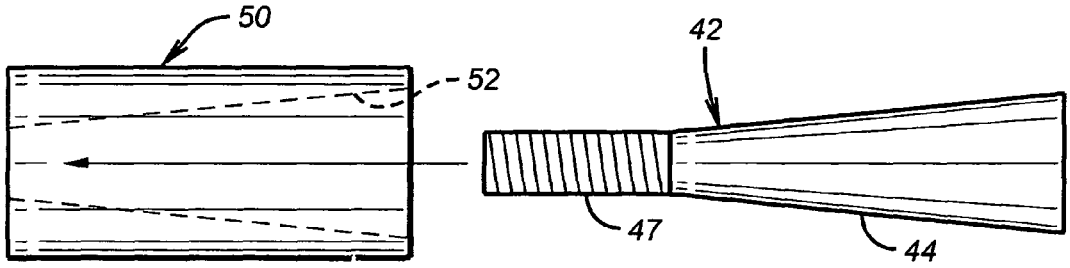
FIG. 7 is an exploded view of the present invention collet bolt
Figure 8:
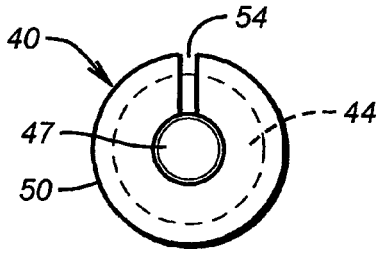
FIG. 8 is an end view of the collet bolt.
Figure 9:
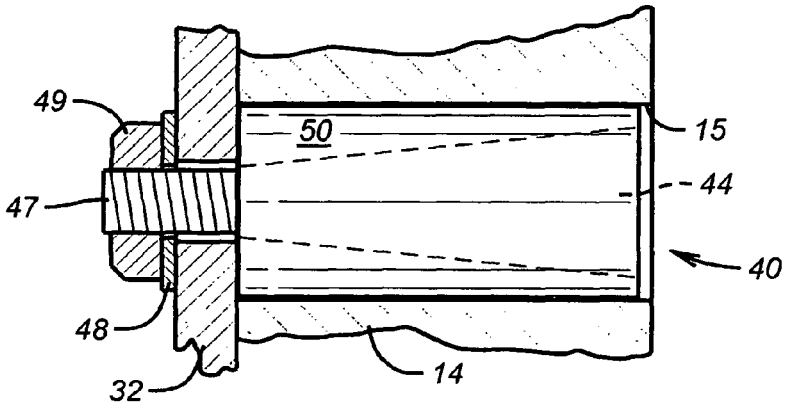
FIG. 9 is a partial section view of the collet bolt assembly

The specialized collet bolt element of the invention is illustrated by FIGS. 7 through 9 and comprises a collet shaft 42 and a collet sleeve 50. The sleeve 50 is preferably a solid steel element having a normal cylinder outside diameter corresponding to a close slip-fit into a stub flange bolt hole 15. The axial length of the collets sleeve is preferably no more than the thickness of the stub flange. Internally, the collet sleeve 50 is given a tapered bore 52. The taper angle and the opposite end diameters of the collet sleeve bore 52 correspond to the dimensions of a tapered mandrel section 44 of the collet shaft 42. In addition to the mandrel section 44, the collet shaft length also includes a threaded extension 47. As shown by FIG. 9, the threaded section 47 is long enough to extend through the mounting tab 32, a washer 46 and a full thread thickness of the nut 49.

Figure 10:
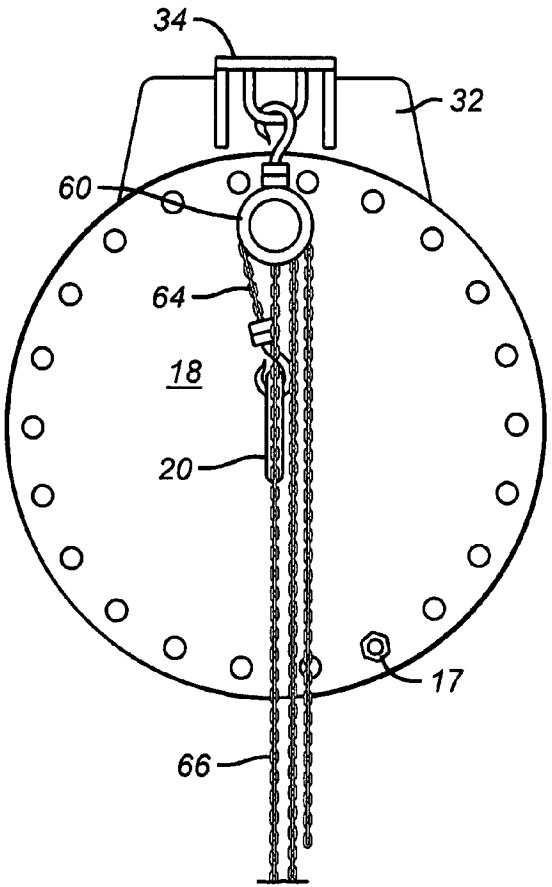
FIG. 10 is a manway cover in closed position with the invention mounted for manway cover removal.

FIG. 10 illustrates the initial or starting position for the present manway cover 18 removal process. Relative to FIG. 10, the Portable support unit 30 is in place and supporting a chain fall 60 having a dynamic load chain 64 and planetary drive chain 66. The load chain 64 is shown as hooked to the bail 20 that is welded to the face of the manway cover. All of the cover flange bolts are removed except for the hinge bolt 17 which is loosened to permit rotation of the cover 18 about the hinge bolt axis.

Figure 13:
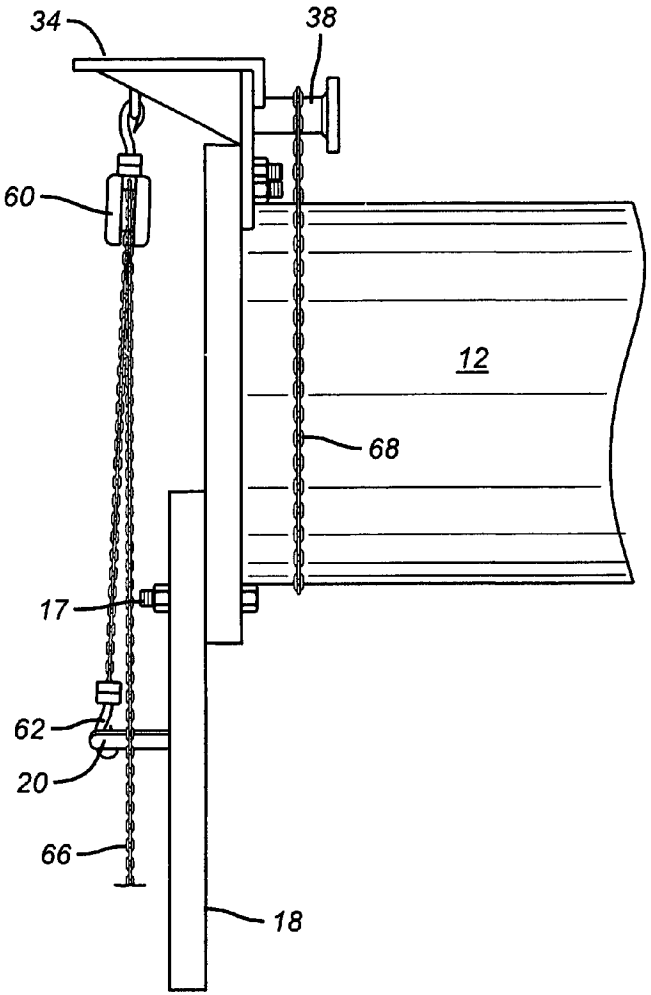
FIG. 13 is a side view of the manway cover displaced by the invention to a fully open position.
Figure 12:
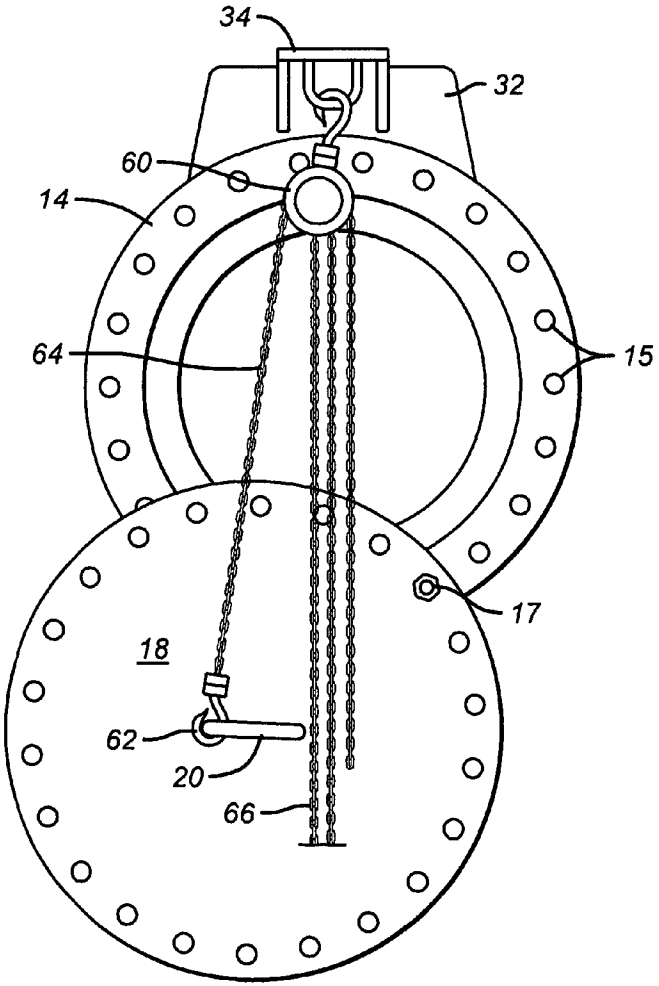
FIG. 12 is a manway cover displaced by the invention to a second, partially open, position.

Drawing one side of the drive chain 66 loop over the chain fall 60 drive sprocket not shown, rotates the load chain sprocket not shown at a predetermined rotational ratio to lengthen the load chain 64 relative to the chain fall 60. The sequence of FIGS. 11 through 13 portrays a progressive rotation of the manway cover 18 about the hinge bolt 17 by a systematic lengthening of the load chain 64.

Figure 14:
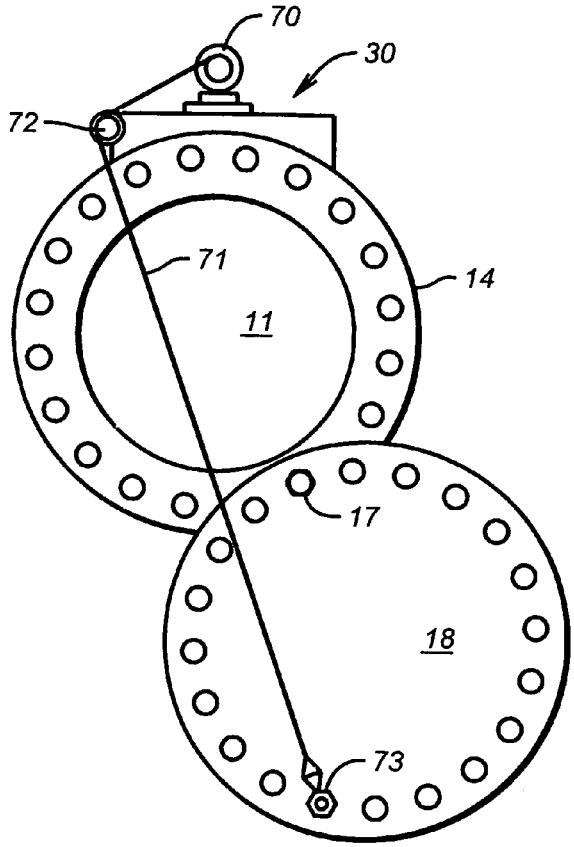
FIG. 14 is an alternative embodiment of the invention using a winch.

The schematic of FIG. 14 portrays an embodiment of the invention that relies upon a powered winch 70 to extend or retract a cable 71 trained over a guide sheave 72. The rotational axis of the guide sheave 72 is secure to the portable support mount 30 at a point of maximum moment from the hinge bolt axis 17 thereby reducing the maximum torque required of the winch to control rotation of the manway cover about the hinge bolt 17. The advantage gained by reducing the torque demand on the winch is to reduce the physical size and weight of the winch. When manually assembling the apparatus at great height or under extreme conditions, component weight reduction contributes greatly to personal safety and assembly speed. A winch 70 of the type contemplated by FIG. 14 may be driven by electricity, hydraulic fluid or compressed air. In many cases, the utility environment will dictate the power mode required. For example, a potentially explosive or highly flammable environment may require only compressed air power to be used. For the same safety reasons, it may be prudent to fabricate the structural elements of the invention of non-ferrous or other non-sparking material. In another envi ronment, only electricity from a portable generator may be available for use. Hydraulic power often has the advantage of a low noise factor. Of course, a manually cranked winch not shown may also be used effectively in the FIG. 14 configuration.

Figure 15:
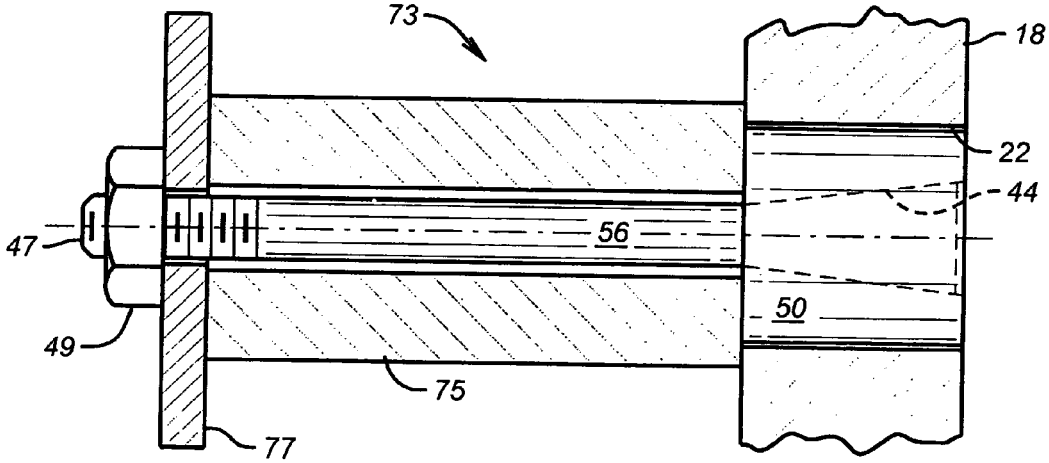
FIG. 15 is a partially sectioned view of a modified collet bolt connector.

The cable 71 point of attachment 73 to the manway cover 18 may rely upon an adaptive form of the collet bolt 40 described relative to FIGS. 7 through 10. In this adaptive form, illustrated in partial section by FIG. 15, a hook-post 73 is secured to a manway cover 18 bolt hole 22 by means of a split collet sleeve 50 expanded by the tapered mandrel end 44 of a collet shaft 56. The collet shaft 56 length is inserted through the central bore of a cylindrical spacer 75 and a shoulder washer 77. The distal end 47 of the collet shaft is threaded to receive a compression nut 49.

Throughout the foregoing specification, numerous references have been made to the "structural" nature of an element. Usually, this term refers to the fabrication material and is intended to include iron, steel, aluminum, brass, bronze, stainless steel and respective alloys. In some instances, non-metallic fabrication materials may be appropriate such as fiberglass and carbon fiber matrices.

Although the invention has been described in terms of specified embodiments which are set forth in detail, it should be understood that these presently preferred embodiments are representative illustration of the invention and that the protected scope of the claimed invention is not necessarily limited to specific embodiments described or illustrated. Alternative embodiments and operating methods will become apparent to those of ordinary skill in the art in view of the teaching derived from the present disclosure. Accordingly, modifications of the invention are contemplated which may be made without departing from the spirit of the claimed invention.

The invention claimed is:

1. A load bearing assembly comprising a pipe flange having a plurality of fastener apertures, a collet fastener and a load bearing structure having an attachment aperture; said collet fastener including a collet sleeve and a collet mandrel, said collet sleeve having an outside cylinder surface diameter proportioned to a slip-fit penetration of a flange fastener aperture, said sleeve having an axial length less than an axial length of a flange fastener aperture, an axial bore along said collet sleeve length that is tapered from a first inside diameter at a first end to a second inside diameter at a second end, said first inside diameter being greater than said second inside diameter, a slot along the length of said collet sleeve between said surface and said axial bore; said collet mandrel having a tapered, substantially smooth first end and threaded shank second end, said mandrel first end having an axial length no greater than the axial length of said collet sleeve, a distal end of said mandrel first end having an outside diameter substantially the same as said collet first inside diameter and a shank end of said mandrel first end having an outside diameter substantially the same as said collet second end diameter; said load bearing structure having an attachment aperture greater than a thread crest diameter of said shank and less than the outside cylinder diameter of said sleeve whereby advancement of a nut along said threaded shank and against said load bearing structure axially displaces said mandrel relative to said sleeve and radially expands said sleeve outside surface against an inside wall of said flange aperture.

2. A load bearing assembly as described by claim 1 having a temporary counter-torque means connecting said load bearing structure with said pipe flange.

3. A load bearing assembly as described by claim 1 wherein said load bearing structure support a controllable length force line device.

* * * * *